US010276006B1

(12) United States Patent
Price et al.

(10) Patent No.: US 10,276,006 B1
(45) **Date of Patent: *Apr. 30, 2019**

(54) WIRELESS TAMPER DEVICE

(71) Applicant: THE BOEING COMPANY, Chicago, IL (US)

(72) Inventors: Wade T. Price, Redmond, WA (US); Bruce R. Olsen, Snohomish, WA (US); Raymond Roeder, Everett, WA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/829,876

(22) Filed: Dec. 2, 2017

(51) Int. Cl.
*G08B 13/12* (2006.01)

(52) U.S. Cl.
CPC ..... *G08B 13/126* (2013.01)

(58) Field of Classification Search
CPC ..... B65D 55/022; B65D 55/028; B65D 55/06
See application file for complete search history.

(56) References Cited

U.S. PATENT DOCUMENTS

2007/0029384 A1* 2/2007 Atherton ..... G06K 19/073 235/435
2008/0143519 A1* 6/2008 Piotrowski ..... G06K 19/07372 340/540
2009/0140857 A1* 6/2009 Krill ..... G08B 13/1436 340/545.1
2009/0309722 A1* 12/2009 Nichols ..... G06Q 10/08 340/541
2010/0171592 A1* 7/2010 Kamemaru ..... H04L 1/0045 340/10.1
2011/0012731 A1* 1/2011 Stevens ..... G01S 5/0027 340/539.31
2011/0074582 A1* 3/2011 Alexis ..... G08B 13/149 340/572.1
2011/0254665 A1* 10/2011 Lindsay ..... G06K 19/0717 340/10.5
2012/0203498 A1* 8/2012 Fleischman ..... G06F 21/86 702/150
2015/0134557 A1* 5/2015 Cova ..... G06Q 10/06 705/333
2017/0004335 A1* 1/2017 Russell ..... G06Q 10/00

* cited by examiner

*Primary Examiner* — Laura N Nguyen

(57) ABSTRACT

Disclosed is a wireless tamper device ("WTD"). The WTD includes a transmitter, multi-layer probe, processing device, and power supply. The processing device is in signal communication with the multi-layer probe and the power supply is in signal communication with the transmitter and processing device. The processing device includes a processor and a computer-readable medium ("CRM"). The CRM has encoded thereon computer-executable instructions to cause the processor to initiating a tamper state to untampered, detect a physical trigger on the multi-layer probe, and set the tamper state to tampered in response to detecting the physical trigger.

19 Claims, 11 Drawing Sheets

WIRELESS TAMPER DEVICE

BACKGROUND

1. Field

The present disclosure is related to sensors, and in particular, to sensors that detect tampering.

2. Related Art

In commercial travel there is a need to screen and secure items placed within storage areas of many commercial vehicles such as, for example, aircraft, buses, ships, trains, or trucks. Additionally, within commercial aircraft, buses, trains, and ships, there may be cabins, closets, pallets, and rooms that need to be kept closed and secure, such as maintenance areas.

In many of these situations, physically locking a specific area may not be an option. For example, the bins above passengers, washrooms, and galleys in a commercial airliner train or bus may need to be easily accessible at one point or another while traveling. As another example, the washrooms in a vehicle may need to be inspected, secured, and closed prior to passengers boarding the vehicle for security purposes. Similarly, in an aircraft, crew related items may need to be stored in an overhead bin or closet that also needs to be closed and secured. Moreover, storage compartments in a galley may also need to be inspected, closed, and secured.

At present, the approach to securing these areas is generally limited to inspecting, closing, and placing a device at the access of the area that may be a door or flap. Examples of the device may include multiple devices or items that provide visual evidence of tamper, such as, for example, a zip tie, an adhesive seal or tape, and a plastic padlock that are permanently altered or broken by a tamper event. For example, in FIG. 1, a system block diagram of an example of an implementation of a known security seal 100 is shown attached to an overhead bin door 102 of an overhead bin 104. The overhead bin 104 may be located within an aircraft, bus, train, or other passenger vehicle. The security seal 100 is located on both the overhead bin body 106 and the overhead bin door 102 in a straddling fashion that bridges the gap 108 between the overhead bin body 106 and the overhead bin door 102.

Turning to FIG. 2, a system block diagram of an example of another implementation of a known security device 200 is shown attached to a secure box 202. Again, the secure box 202 may be located within an aircraft, bus, train, or other passenger vehicle. The security device 200 may be a padlock type device, zip tie, adhesive seal or tap, or other similar device. The security box 202 may be a storage location having a lid 204 that is utilized to store secure items that include, for example, crew items and/or emergency equipment, life vest(s), fire extinguisher, automated external defibrillator ("AED"), etc. In this example, the security device 200 may be a padlock type device that attaches to an attachment device 206 that is located on both the lid 204 and a front wall 208 of the security box 202 in a straddling fashion that bridges a gap 210 between the front wall 208 and the lid 204.

In both examples, if either the overhead bin door 102 or security box 202 lid 204 is opened, the corresponding security seal 100 or security device 200 will be physically and visibly damaged indicating that someone opened (or attempted to open) either the overhead bin door 102 or lid 204. Generally, the security seals (such as security seal 100 or security device 200) are a type of tape or device that are usually known as, for example, tamper seals, security seals, tamper evident security seals, security tapes, tamper evident tapes, plastic zip ties, or padlocks, which for the purpose of simplicity are herein referred to as "security seals" or "security devices." In general, these security seals or devices are designed to be visually inspected and easily recognized if tampered with or broken. As an example, security seals or devices are utilized in commercial aircraft to help ensure that any items placed onto the aircraft have been cleared by the relevant security personnel, and once cleared, those items are sealed to make sure that they cannot be tampered with before, during and post flight.

Unfortunately, while useful, these types of security seals or devices require the relevant security personal or crew member to walk through the vehicle and visually, and possibly physically, inspect each security seal or device individually to see if it has been tampered. As a result, this leads to downtime of the vehicle and increased manual labor costs related to the physical inspection of all of the security seals or devices on the vehicle. Therefore, there is a need for a system and method that addresses the limitations of the known security seals and devices.

SUMMARY

A wireless tamper device ("WTD") is disclosed. The WTD includes a transmitter, multi-layer probe, processing device, and power supply. The processing device is in signal communication with the multi-layer probe and the power supply is in signal communication with the transmitter and processing device. The processing device includes a processor and a computer-readable medium ("CRM"). The CRM has encoded thereon computer-executable instructions to cause the processor to initiating a tamper state to untampered, detect a physical trigger on the multi-layer probe, and set the tamper state to tampered in response to detecting the physical trigger.

In an example of operation, the WTD performs a method that includes initiating a tamper state to untampered, detecting a physical trigger, and setting the tamper state to tampered in response to detecting the physical trigger.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Disclosed is a wireless tamper device ("WTD"). The WTD includes a transmitter, multi-layer probe having predetermined electrical characteristics, processing device, and power supply. The processing device is in signal communication with the multi-layer probe and the power supply is in signal communication with the transmitter and processing device. The processing device includes a processor and a computer-readable medium ("CRM"). The CRM has encoded thereon computer-executable instructions to cause the processor to initiate a tamper state to untampered, detect a physical trigger on the multi-layer probe, and set the tamper state to tampered in response to detecting the physical trigger. As such, in an example of operation, the WTD performs a method that includes initiating a tamper state to untampered, detecting a physical trigger, and setting the tamper state to tampered in response to detecting the physical trigger.

Figure 1:
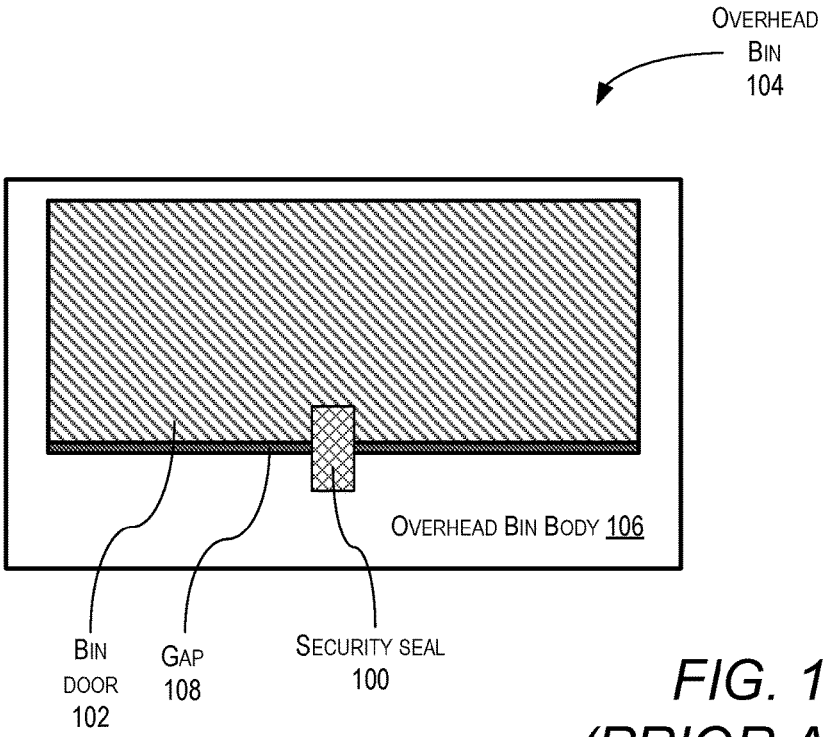
FIG. 1 (PRIOR ART)
FIG. 1 is a system block diagram of an example of an implementation of a known security seal attached to an overhead bin door of an overhead bin.
Figure 2:
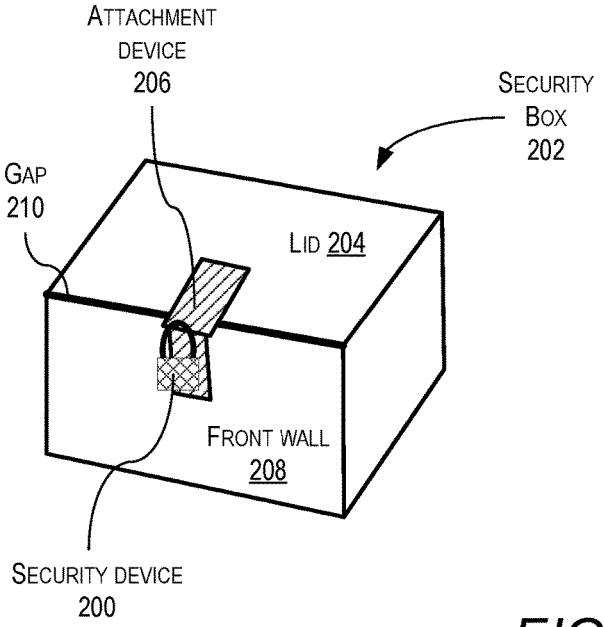
FIG. 2 (PRIOR ART)
FIG. 2 is a system block diagram of an example of another implementation of a known security device attached to a security box.
Figure 3:
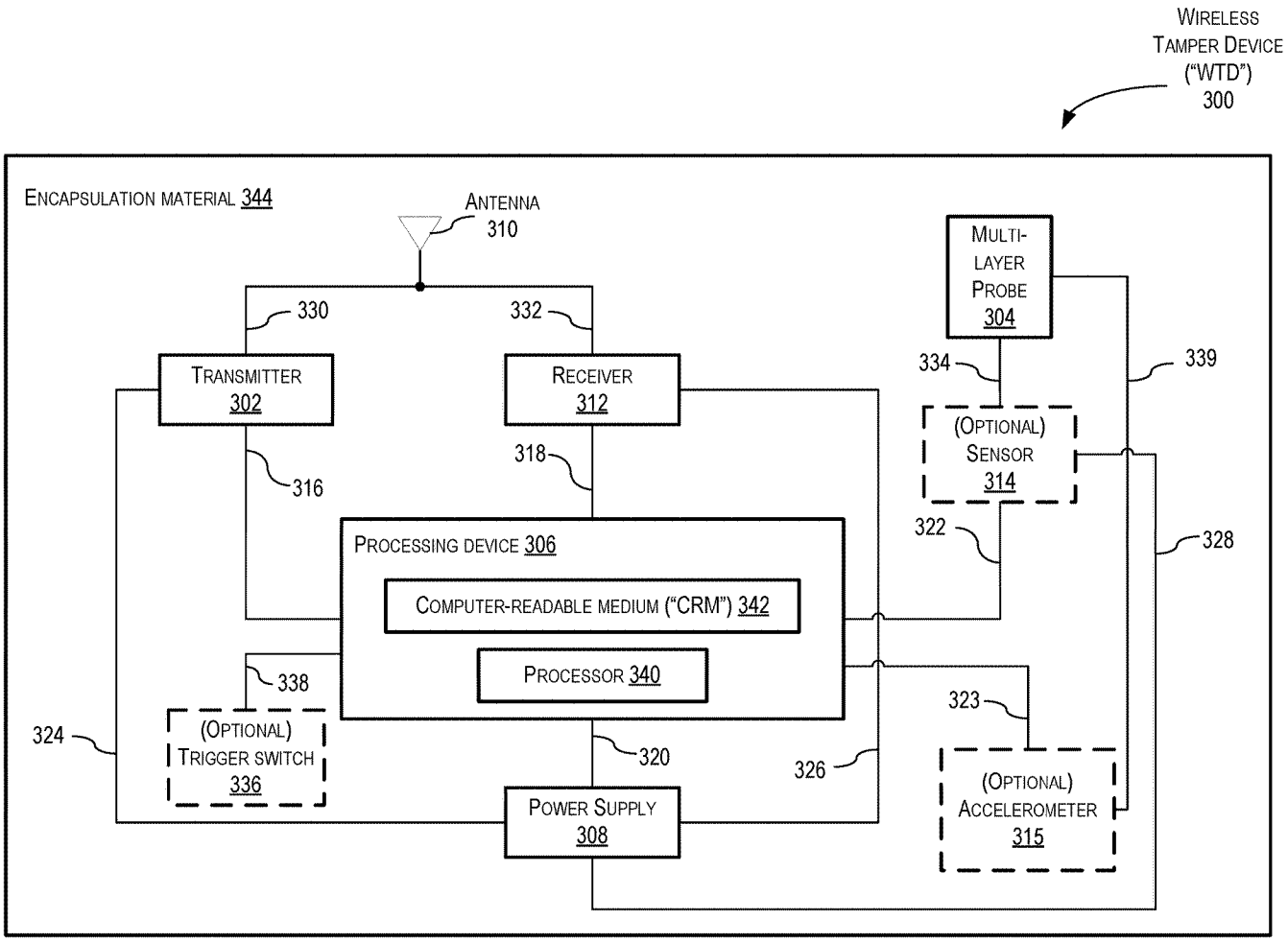
FIG. 3 is a system block diagram of an example of an implementation of a wireless tamper device ("WTD") in accordance with the present disclosure.

In FIG. 3, a system block diagram is shown of an example of an implementation of the WTD 300 in accordance with the present disclosure. The WTD 300 includes a transmitter 302, multi-layer probe 304, processing device 306, and a power supply 308. The WTD 300 may also include an antenna 310, receiver 312, optional sensor 314, and optional accelerometer 315 (or other solid-state electronic sensor capable of measuring movement and/or vibration). In this example, the processing device 306 is in signal communication with the transmitter 302, receiver 312, power supply 308, optional sensor 314, and the optional accelerometer 315 via signal paths 316, 318, 320, 322, and 323, respectively. The power supply 308 is in signal communication with the transmitter 302, receiver 312, and the optional sensor 314 via signal paths 324, 326, and 328, respectively. The antenna 310 is in signal communication with the transmitter 302 and receiver 312 via signal paths 330 and 332, respectively. Moreover, the multi-layer probe 304 is in signal communication with the optional sensor 314 via signal path 334 and the processing device 306 via the optional sensor 314 and signal paths 334 and 322. In this example, the WTD 300 may optionally also include an optional trigger switch 336 in signal communication with the processing device 306 via signal path 338. The optional accelerometer 315 may be in signal communication with the multi-layer probe 304 via signal path 339.

In this example, the processing device 306 may include a processor 340 and a computer-readable medium ("CRM") 342. In general, the CRM 342 has encoded thereon computer-executable instructions to cause the processor 340 to perform different functions in the operation of the WTD 300. The processor 340 may be any microprocessor or similar device, such as, for example, a central processing unit ("CPU"), digital signal processing ("DSP") device, application specific integrated circuit ("ASIC"), or a field programmable-gate array ("FPGA"). In general, the CRM 342 may be software or firmware and the computer-executable instructions stored on the CRM 342 may include, for example, an operating system, software, and other modules, programs, or applications that are loadable and executable by processor 340. Moreover, in the example of the CRM 342 being firmware, the computer-executable instructions may include hardware logic (i.e., machine instructions) that controls the operation of the processor 340. In this example, the CRM 342 may be in signal communication with the processor 340 via a signal path that includes a bus.

The power supply 308 may be a battery configured to power the WTD 300 for an extended period of time. It is appreciated by those of ordinary skill in the art that the transmitter 302 and receiver 312 may be independent devices or combined together to form part of a transceiver. The multi-layer probe 304 may be any type of multi-layer device capable of detecting a physical force (i.e., a physical trigger) associated with a tampering activity where the physical trigger may include physically damaging or breaking the multi-layer probe 304. Examples of the multi-layer probe 304 include multiple layers of material that may include a wire, electrical substrate, or other electrically conductive material. In general, the multi-layer probe 304 may include two or more layers of material placed together that cause the multi-layer probe 304 to have predetermined electrical characteristics that may include, for example, a predetermined impedance, capacitance, inductance, dielectric properties, breakdown voltage, etc. Once tampered, the multi-layer probe 304 may be physically modified or damaged such that the layers of material within the multi-layer probe 304 partially or fully move or separate from each other in a way that substantially alters and changes the electrical characteristics of the multi-layer probe 304 from the original predetermined electrical characteristics.

In general, the multi-layer probe 304 is an electrical implementation of a security device similar to, for example, a security tape (also known as security label) that is a type of adhesive tape used to detect tampering. In general, security tape is a pressure sensitive tape or label with special tamper resistant or tamper evident features. These special tamper resistant or tamper evident features may include intentionally weak or frangible components that easily fracture or tear, printing which, when cut or torn, cannot easily be realigned, layers that easily delaminate to show entry or tampering, hidden print layers which indicated an opening or tampering, etc. In this example, the multi-layer probe 304 may also include special tamper resistant or tamper evident features that allow the WTD 300 to indicate that the WTD 300 has been tampered with. The multi-layer probe 304 may include multiple layers of material that are sandwiched together to form the multi-layer probe 304. As an example, some of these layers may be electrically conductive and some may be isolative that act as a dielectrics between the electrically conductive layers. In an example of operation, a current may be induced to flow between the electrically conductive layers and through the dielectric layers between the electrically conductive layers. Without a tampering event, the multi-layer probe 304 may have predetermined electrical characteristics that lets the multi-layer probe 304 allow a certain amount of current to flow through the multi-layer probe 304 with a corresponding predetermined voltage drop across the inputs to the multi-layer probe 304. Moreover, in this example, the multi-layer probe 304 may have a predetermined impedance value corresponding to combination of resistive, capacitive, and inductive properties of the multi-layer probe 304. If the multi-layer probe 304 is then tampered (i.e., experiences a tampering event also referred to as a physical trigger associated with the tampering activity) that causes the movement, displacement, or damage of one or more layers of the multi-layer probe 304, this tamper will cause a physical variation or deformation of the layers within the multi-layer probe 304 that may change the distance, orientation, or both, between the electrically conductive layers and deformation or damage to the dielectric layers. As an example, this tamper may introduce cracks, breaks, and air gaps within layered structure of the multi-layer probe 304. These changes will result in changes to resistance, capacitance, inductance, and possibly the effect dielectric properties of material layers within the multi-layer probe 304 that cause the multi-layer probe 304 to have new electrical characteristics that are different than the original predetermined electrical characteristics. As such, the WTD 300 may utilize these changed electrical characteristics to identify a triggering event corresponding to a tampering event as experienced by the multi-layer probe 304.

As another example, the multi-layer probe 304 may include multiple layers within the multi-layer probe 304 where one or more layers may include one or more electrical probes such as conductive strips or wires. In this example, the one or more electrical probes may include just one electrical wire or strip within the multi-layer probe 304 that is electrically connected to other devices of the WTD 300 and completes a circuit that passes a predetermined amount of current and has predetermined electrical characteristics. Alternatively, two or more electrical wires or strips may be utilized where the two or more electrical wires or strips interact with each other, e.g., one electrical wire or strip may act as an input to the multi-layer probe 304 while another electrical wire or strip may act as an output to the multi-layer probe 304. In this example, the first electrical wire or strip may be in signal communication with the second electrical wire or strip through the other dielectric layers of the multi-layer probe 304.

In this example, if the multi-layer probe 304 is then tampered in a way that causes the movement, displacement, or damage of one or more layers of the multi-layer probe 304, this tamper will cause a physical variation or deformation of the layers within the multi-layer probe 304 that may change the distance, orientation, or both, between the electrically wires or strips and deformation or damage to the dielectric layers. Moreover, the tamper may also damage or break one or more of the electrical wires or strips. As described earlier, this tamper may introduce cracks, breaks, and air gaps within layered structure of the multi-layer probe 304. These changes will result in changes to resistance, capacitance, inductance, and possibly the effect dielectric properties of material layers within the multi-layer probe 304 that cause the multi-layer probe 304 to have new electrical characteristics that are different than the original predetermined electrical characteristics. As such, the WTD 300 may utilize these changed electrical characteristics to identify a triggering event corresponding to a tampering event as experienced by the multi-layer probe 304.

Also as yet another example, the antenna 310 may be the multi-layer probe 304. In other words, the antenna 310 and multi-layer probe 304 may be the same element (i.e., device, component, module, or circuit) where the antenna 310 may have an antenna length that is approximately equal to a fractional length (such as, for example, a half-wavelength) of an operating frequency of operation of the transmitter 302 and receiver 312. In this example, the physical trigger may be a damaging or breaking of the antenna 310 that results in the reduction of the antenna length. It is appreciated by those of ordinary skill in the art that changing the antenna length of the antenna 310 will alter the electrical properties of the antenna 310 that include, for example, causing the antenna 310 to operate at a new shifted frequency (i.e., it will result in a new operating frequency that is equal to the new reduced antenna length of the antenna 310 after the breakage or damage of the antenna 310 by the tampering activity), be less efficient at receiving and transmitting signals at the original frequency of operation of the transmitter 302 and receiver 312 (i.e., the quality of reception and transmission will be degraded), and changing the input impedance of the antenna 310.

In some implementations the WTD 300 may not have an optional sensor 314 and the multi-layer probe 304 will be in direct signal communication (i.e., directly connected) to the processing device 306, where the processing device 306 will include a module or logic capable of sensing the physical trigger associated with the tampering activity. As described earlier, the WTD 300 may optionally include the optional sensor 314 or not because the multi-layer probe 304 may be in direct signal communication with processing device 306. However, if present, the optional sensor 314 may be a device, component, module, or circuit configured to sense the physical trigger on the multi-layer probe 304. If the optional trigger switch 336 is included in the WTD 300, the optional trigger switch 336 may be a user activated switch that arms the WTD 300 to detect the physical trigger on the multi-layer probe 304 by initiating a tamper state of the WTD 300 to "untampered."

In addition to, or instead of, the optional sensor 314, the WTD may also optionally include the optional accelerometer 315. An accelerometer is a device that measures the proper acceleration of the device, which is a rate of change of velocity of the device in its own instantaneous rest frame (i.e., measures movements or vibrations of the device). If present in the WTD 300, the optional accelerometer 315 detects any movement or vibration (which is a very small movement that is an oscillating, reciprocating, or other periodic type of motion) as the physical trigger.

In this example, the entire WTD 300 may be partially or completely enclosed by an encapsulation material 344 that may include, for example, paper, cloth, elastomer, nitrile, fluorosilicone, fluoroelastomer, neoprene, silicone, ethylene propylene diene monomer ("EPDM") rubber, fabric, polymeric material, ceramic, thin metal, or other material. In general, the encapsulation material 344 may be referred to as a sensor external substrate.

It is appreciated by those skilled in the art that the circuits, components, modules, and/or devices of, or associated with, the WTD 300 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

In general, as an example of operation, the computer-executable instructions of the CRM 342 will cause the processor 340 to initiate a tamper state to untampered, detect a physical trigger on the multi-layer probe 304, and set the tamper state to tampered in response to detecting the physical trigger. In this example, the computer-executable instructions of the CRM 342 may initiate the tamper state to untampered either by a user arming the WTD 300 via the optional trigger switch 336 or by receiving a "wake" command from an external device in signal communication with the WTD 300. The external device may be a server, user portable device, or other wireless device capable of interfacing with the WTD 300. In this example, the term "arming" or "armed" is utilized to designate that the WTD 300 is placed in a state that detects any tampering on the WTD 300 by either moving or damaging the WTD 300.

If the WTD 300 is armed by an external device, the computer-executable instructions of the CRM 342 will cause the processor 340 to receive the wake command from the external device and then authenticate the wake command. It is appreciated by those of ordinary skill in the art that the wake command may be authenticated by a process that includes determining that the external device is an "authenticated interrogator" by utilizing a series of predetermined security protocols. Once the wake command is authenticated, the computer-executable instructions of the CRM 342 then causes the processor 340 to initiate the tamper state to untampered. In this example, it is assumed that the tamper state of the WTD 300 is in a state that is not "untampered" but may not be in a state that is "tampered;" however, it is also appreciated that the state of the WTD 300 may vary based on the design of the WTD 300.

In another example, it is appreciated by those of ordinary skill in the art that setting the state to untampered may involve more than only receiving the wake command. The wake command may include instructions to set the tamper state to untampered, or, other instructions. Specifically, receiving the wake command may be for initial setup only where the WTD 300 may initially be running in a lower power scheme where the WTD 300 is in a dormant state for several seconds, powers up the processor device 306 for a short time (for example, a few milliseconds) to listen to the receiver 312 for an authenticated command signal that may be an independent signal from the initial wake command. In this example, the wake command may only cause the processing device 306 to query the receiver 312 for a wake package of information for what operation is being requested, which may include to set the state to untampered, or to query the WTD 300 state and then send a report, or possibly other encoded functionality at the processing device 306. In the case of authenticated command signal, once authenticated the processing device 306 may further execute instructions that may set the initial state of the WTD 300 to untampered, to read the sensor current state, read the power level remaining, generate a report, instruct to transmit, or other instructions. In another example, the wake command may also act as a "reset" function to place the WTD 300 into the untampered state.

For example, the WTD 300 may include an "off" state prior to being deployed and initiating the tamper state to untampered may include changing the off state to the untampered state by arming the WTD 300 either with the optional trigger switch 336 or the wake command from the external device. Alternatively, the WTD 300 may only include two states (i.e., untampered and tampered) and initiating the tamper state to untampered may include powering up the components of the WTD 300 once the wake command is received and authenticated or the user arms the WTD 300 via the optional trigger switch 336. In either example, the WTD 300 is armed by a user directly (via the optional trigger switch 336) or a user wirelessly (via a wireless connection with the external device).

In yet another example, the WTD 300 may be a resettable device capable of being reutilized after first use. In this example, the WTD 300 may have been first utilized in a situation that detected that the WTD 300 was tampered with by a physical trigger. As an example, the WTD 300 includes the optional accelerometer 315 and the WTD 300 is utilized to monitor tampering of a door where the WTD 300 is placed on the door and armed. The door is subsequently moved causing the computer-executable instructions to cause the processor 340 to first detect the physical trigger (i.e., the movement of the door) on the multi-layer probe 304, which may be in signal communication with the optional accelerometer 315, and then set the tamper state to tampered in response to detecting the physical trigger. However, since in this example the physical trigger is the movement of the door and the movement has not caused any damage to the WTD 300, the WTD 300 may be reset and utilized again either on the same door or in another application that needs to detect movement. In this example, the WTD 300 may not include the optional sensor 314 (because the sensor for movement is the optional accelerometer 315) nor a separate multi-layer probe 304 that is independent from the optional accelerometer 315 because the multi-layer probe 304 may be part of the optional accelerometer 315 or an extension of it such as, for example, a mechanical filter (i.e., a vibration filter). In this example, once the WTD 300 is ready for reuse, the WTD 300 may receive a reset signal from the external device or the user may again activate the optional trigger switch 336 that causes the computer-executable instructions to cause the processor 340 to reset the state of the WTD 300 back to untampered and the WTD 300 may again monitor the door for another physical trigger.

In operation, once the WTD 300 has been triggered, the WTD 300 may, for example, transmit a tamper state signal in response to detecting the physical trigger, wait to receive a status command from the external device, or do nothing. In the first example, once tampered (i.e., a physical trigger was detected on the multi-layer probe 304 or the optional accelerometer 315) the computer-executable instructions cause the processor 340 to set the tamper state to tampered in response to detecting the physical trigger. The computer-executable instructions then cause the processor 340 to transmit a tamper state signal in response to detecting the physical trigger, where the tamper state signal indicates that the tamper state is tampered. In this example, the transmitter 302 may transmit the tamper state signal as a beacon or other repetitive transmission to the external device. In this example, the antenna 310 may be a distinct element from the multi-layer probe 304 and the multi-layer probe 304 may have been broken or damaged. Alternatively, the optional accelerometer 315 may be a combination of the optional sensor 314 and multi-layer probe 304 and the transmitter 302 transmits the tamper state signal via the antenna 310. In another alternative, the multi-layer probe 304 is the antenna 310 and the transmitter 302 transmits the tamper state signal via the antenna 310 that has been damaged or broken, which reduced the antenna length of the antenna 310. As a result, the antenna 310 receives the tamper state signal from the transmitter 302 and transmits it at an altered frequency (as compared to the original operation frequency of the transmitter 302) because of the reduction of antenna length caused by the physically trigger. In all of these situations, the WTD 300 transmits the tamper state signal automatically after detecting the physical trigger.

In the second example, the WTD 300 does not automatically transmit the tamper state signal when a physical trigger is detected. Instead, the WTD 300 waits to be queried by the external device as to its tamper status. When the WTD 300 receives a status command from the external device, the computer-executable instructions cause the processor 340 to receive the status command from the external device and transmit the tamper state signal in response to receiving the status command. Similar to the first example, in this example, the antenna 310 may be a distinct element from the multi-layer probe 304 and the multi-layer probe 304 may have been broken or damaged. Alternatively, the optional accelerometer 315 may be a combination of the optional sensor 314 and multi-layer probe 304 and the transmitter 302 transmits the tamper state signal via the antenna 310. In another alternative, the multi-layer probe 304 is the antenna 310 and the transmitter 302 transmits the tamper state signal via the antenna 310 that has been damaged or broken reducing the antenna length of the antenna 310. As a result, the antenna 310 receives the tamper state signal from the transmitter 302 and transmits it at a shifted frequency because of the reduction of antenna length caused by the physically trigger. In all of these situations, the WTD 300 transmits the tamper state signal only after detecting the physical trigger and receiving the status command from the external device.

In the third example, the WTD 300 does nothing if a physical trigger is detected. In this example, once tampered the computer-executable instructions may cause the processor 340 to set the tamper state to tampered in response to detecting the physical trigger or do nothing. Specifically, once the WTD 300 is armed (either by the optional trigger switch 336 or a wake command from an external device), the WTD 300 may be automatically placed in an untampered tamper state (i.e., the WTD 300 is armed and ready to detect a physical trigger). While in this untampered tamper state, the WTD 300 may either automatically transmit a tamper state signal as a beacon or other repetitive transmission to the external device or wait for a query from the external device before answering the query (i.e., the status command) with the tamper state signal. In this example, the WTD 300 may be in a sleep state, which will not check the tamper state until receiving an authenticated request for status, at which time the processing device 306 queries directly to the optional sensor 314 to determine the state as tampered or untampered, after which WTD 300 immediately reports the state status to the external device.

In either case, once the physical trigger happens, the WTD 300 may continue to transmit the tamper state signal either automatically or when queried or "go silent" and not transmit any tamper state signal. In these examples, there are three situations that may affect the ability of the WTD 300 to transmit the tamper state signal. In the first and second situations, the antenna 310 is the multi-layer probe 304 and it suffers damage from the physical trigger that either breaks or damages the antenna 310 but the antenna 310 is still functioning and able to transmit a signal. In these situations (as discussed earlier), the WTD 300 continues to transmit the same tamper state signal without changing the tamper state of the signal in the processor 340. As discussed earlier, in these cases the antenna 310 will alter the frequency of transmission of the tamper state signal because of the reduction of the antenna length. If the external device is configured to detect the change in transmitted frequency by the antenna 310, then there is no need to have the processor 340 change the tamper state of the WTD 300 since the tampering activity itself has caused an effective "change in state" since the resulting transmission of the tamper state signal will automatically shift in frequency based on the damage caused to the antenna 310 and the external device may be configured to detect that frequency shift and flag it as indicating that the WTD 300 has been tampered. As such, in these situations the WTD 300 does not need to do anything different once armed since the physical trigger has caused damage to the antenna 310 that causes a frequency shift that is detectable by the external device as a flag indicating that the WTD 300 has been tampered.

In the third situation, the damage to the multi-layer probe 304 may be so great that the WTD 300 is not be able to transmit a tamper state signal thus indicating that the WTD 300 has been tampered. For example, if the multi-layer probe 304 is the antenna 310, the damage to the antenna 310 may be so great that the antenna 310 is not function and thus not capable of transmitting the tamper state signal. Since the external device is expecting a response from the WTD 300 (in response to the status command), the external device will flag the WTD 300 as tampered because no signal was received by the external device. Alternatively, the WTD 300 may be configured to always respond to a status command queried by the external device when in the untampered tamper state but once tampered (i.e., once the physical trigger is detected), the WTD 300 may simply stop transmitting any reply to the status command. Again, in this situation, since the external device is expecting a response from the WTD 300 (in response to the status command), the external device will flag the WTD 300 as tampered.

It is appreciated that in these examples, the WTD 300 may be designed such that when the computer-executable instructions cause the processor 340 to initiate the tamper state to untampered, the computer-executable instructions are simply arming the WTD 300 for operation in detecting a physical trigger that will eventual move the optional accelerometer 315 or damage the multi-layer probe 304 (which may be the antenna 310). This may include simply turning the power on for the components (i.e., the transmitter 302, receiver 312, accelerometer 315, processing device 306, optional sensor 314, and multi-layer probe 304) of the WTD 300 so as to be able to detect the physical trigger. In this example, the WTD 300 is placed in a tampered tamper state automatically when the physical trigger happens because the physical trigger actually physically effects the WTD 300 (i.e., it moves or damages the WTD 300) in such a way that when the computer-executable instructions cause the processor 340 to set the tamper state to tampered in response to detecting the physical trigger, the computer-executable instructions are simply preparing the WTD 300 to transmit the tamper state signal either automatically or in response to receiving the status command.

Figure 4:
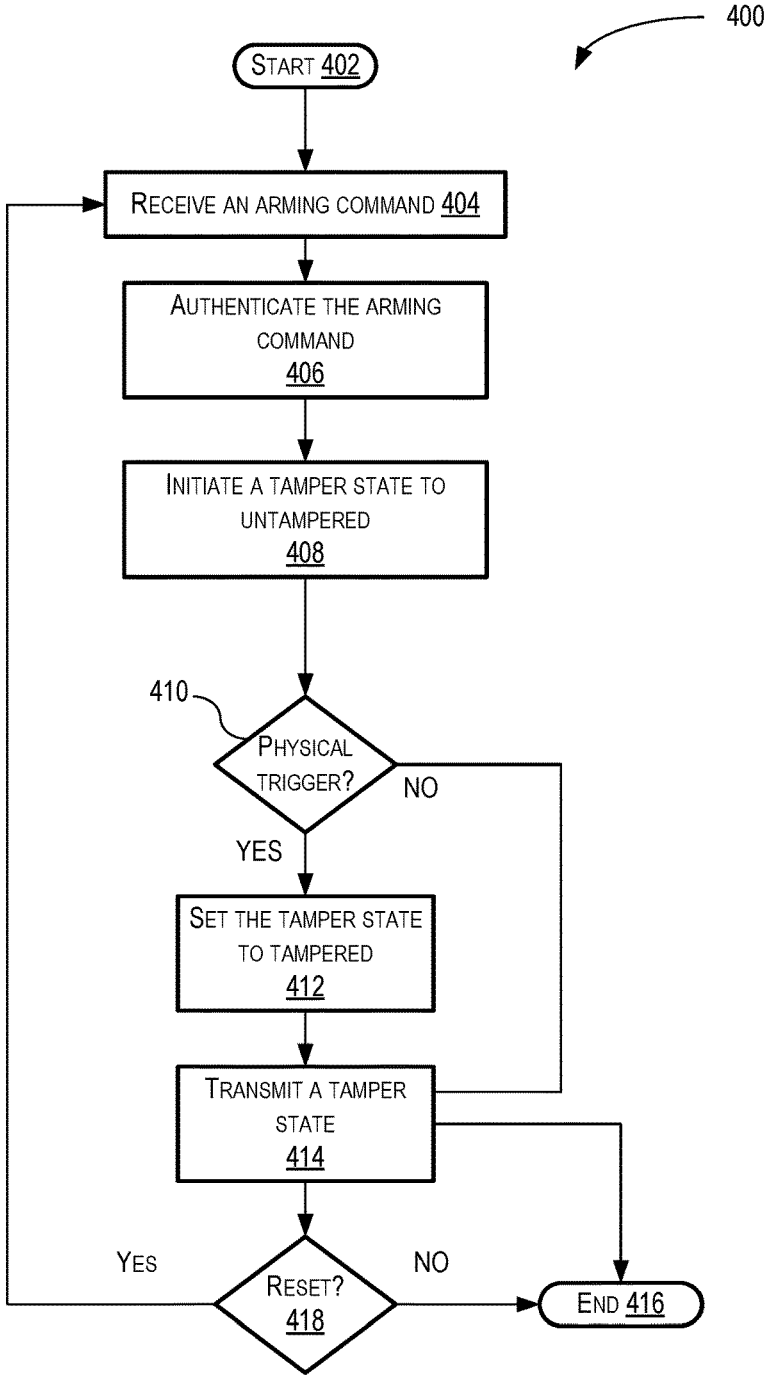
FIG. 4 is a flowchart of an example of an implementation of the method performed by the WTD, shown in FIG. 3, in accordance with the present disclosure.

Turning to FIG. 4, a flowchart is shown of an example of an implementation of the method 400 performed by the WTD 300 in accordance with the present disclosure. The method 400 starts 402 by receiving an arming command 404. As described earlier, the arming command may be a command produced by a user activating the optional trigger switch 336 or by receiving a wake command from the external device. If the arming command is the wake command from the external device, the arming command is then authenticated 406. The arming command then causes the WTD 300 to initiate the tamper state to untampered 408 as described earlier. The WTD 300 is then armed and ready to detect a physical trigger. If no physical trigger is detected, the WTD 300 remains in the armed state and ready to detect the physical trigger. The WTD 300 may then enter into a passive state that does not transmit anything until the WTD 300 receives an authenticated request for state status. Once the physical trigger is detected 410, the WTD 300 sets the tamper state to tampered 412 (as described earlier) in a fashion that may be the automatic result of the physical condition of the WTD 300 (as described earlier). The WTD 300 may then either transmit a tamper state signal 414 or wait for a status command (as described earlier) and then, in response, transmit the tamper state signal 414. In the case that the WTD 300 is an untampered state and there is no physical trigger detected 410, the WTD 300 may skip step 412 and optionally transmit a tamper state 414 of "untampered." Alternatively, the WTD 300 may not transmit any signal as described earlier. The method 400 may then end 416. If the WTD 300 is resettable (i.e., the WTD 300 was not damaged and reusable as described earlier), the method 400 may return to step 404, if the WTD 300 is reset, and wait for another arming command that may include a reset signal from the external device. If the WTD 300 is not reset, the method 400 then ends 416.

In this example, the WTD 300 utilizes energy to check for state of the WTD 300 and revise the state of the WTD 300 independent of the external query but in alternative example, the WTD 300 may only check for state once an authenticated status report command is received. Additionally, the WTD 300 may not transmit (i.e., send a state report) unless it receives an authenticated request to report the tamper state. Otherwise, the WTD 300 may cycle between dormant and listen-on-radio (i.e., monitor the receiver 312).

Figure 5A:
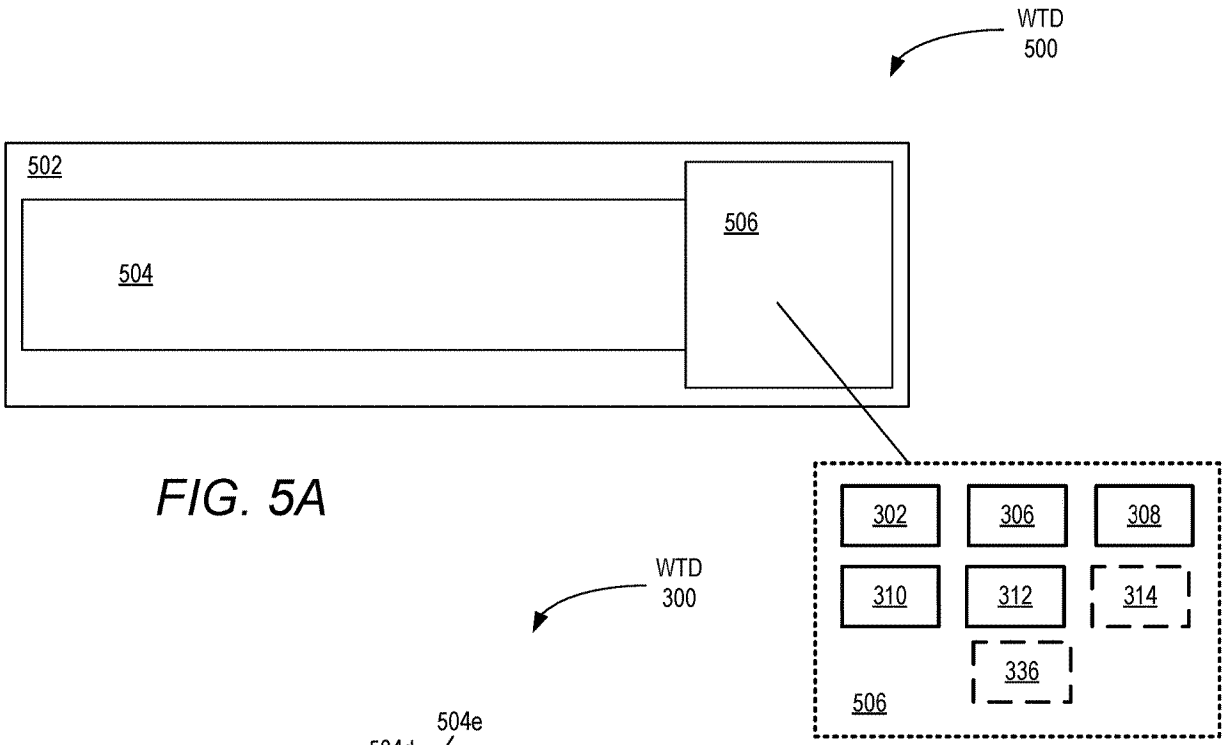
FIG. 5A is a top-view of an example of an implementation of the WTD as a security tape or security label type of device in accordance with the present disclosure.

In FIG. 5A, a top-view is shown of an example of an implementation of the WTD 500 as a security tape or security label type of device (i.e., a "Band-Aid" type of device) in accordance with the present disclosure. In this example, the encapsulation material 502 may be in the shape of tape or label including part, or all, of the multi-layer probe 504 within the encapsulation material 502. In this example and as described earlier, the multi-layer probe 504 may be a multi-layered device that includes a plurality of material layers (i.e., multiple layers of material) within the multi-layer prober 504 that may include a wire, electrical substrate, or other electrically conductive material. The multi-layer probe 504 may include two or more layers of material placed together that cause the multi-layer probe 504 to have predetermined electrical characteristics that may include, for example, a predetermined impedance, capacitance, inductance, dielectric properties, breakdown voltage, etc. The WTD 500 may utilize these changed electrical characteristics to identify a triggering event corresponding to a tampering event as experienced by the multi-layer probe 504. The multi-layer probe 504 may also include multiple layers within the multi-layer probe 504 where one or more layers may include one or more electrical probes such as conductive strips or wires.

In this example, the encapsulation material 502 that may include, for example, paper, cloth, elastomer, nitrile, fluorosilicone, fluoroelastomer, neoprene, silicone, EPDM rubber, fabric, polymeric material, ceramic, thin metal, or other material. In general, the encapsulation material 502 may be referred to as a sensor external substrate.

In this example, the encapsulation material 502 includes an electronic portion 506 of the WTD 500 that includes the transmitter 302, receiver 312, antenna 310, processing device 306, power supply, and part of the multi-layer probe 504. The encapsulation material 502 may also include the optional sensor 314 and optional trigger switch 336. In this example, the electronic portion 514 includes the power supply 308 and a system on a chip ("SOC"), ASIC, FPGA, or a substrate or printed circuit board ("PCB") having the transmitter 302, receiver 312, antenna 310, and processing device 306. Moreover, in this example, the WTD 500 detects tampering (i.e., a physical trigger) via deformation, damage, or break of the multi-layer probe 504.

In this example, the multi-layer probe 504 is shown to have five (5) layers of material 504*a*, 504*b*, 504*c*, 504*d*, and 504*e*. This number of layers of material is for illustration purposes only and it is appreciated by those of ordinary skill in the art that they number of layers can vary based on the design from a minimum of two (2) to any number determined by the design. In this specific example, the lower layer 504*e* may be support layer that supports the electronic portion 506 and the remaining layers of the multi-layer probe 504. For the purpose of attaching the WTD 500 to a surface, the lower layer 504*e* may include an attachment surface 508 at the bottom of the WTD 500 that attaches to the surface to be monitored. The attachment surface 508 may include any attachment means that will properly attach the attachment surface 508 to the surface to be monitored and may include an adhesive.

Figure 5B:
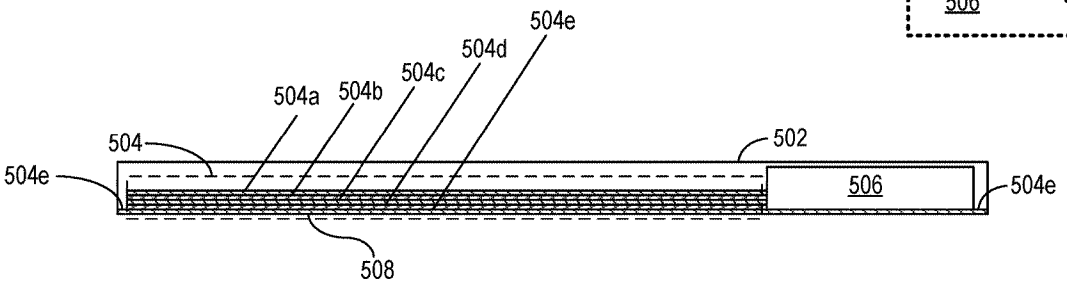
In FIG. 5B is a side-view of an example of the implementation of the WTD, shown in FIG. 5A, in accordance with the present disclosure.

In FIG. 5B, a side-view is shown of an example of the implementation of the WTD 500 in accordance with the present disclosure. It is appreciated by those of ordinary skill in the art that the WTD 500 illustrated in FIGS. 5A and 5B are not so scale and for illustration purpose only. As such, the relative size and dimensions of the multi-layer probe 504, electronic portion 506, and encapsulation material 502 may vary based on the design of the WTD 500.

Figure 5C:
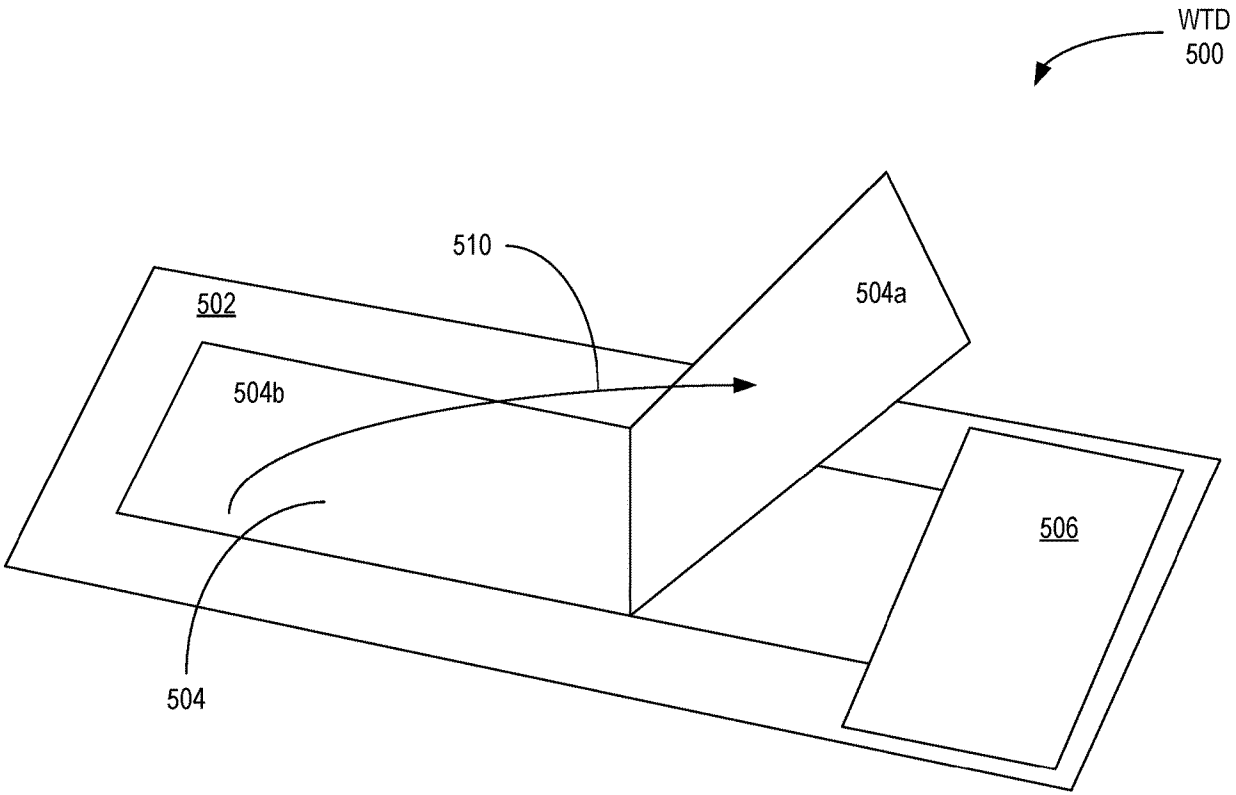
FIG. 5C is a prospective-view of the WTD, shown in FIGS. 5A and 5B, where a trigger event has occurred in accordance with the present disclosure.

Turning to FIG. 5C, a prospective-view is shown of the WTD 500 where a trigger event (i.e., a tamper) has occurred in accordance with the present disclosure. In this example, the first layer of material 504*a* of the multi-layer probe 504 has been substantially altered (i.e., damaged) to the point of being peeled off from the second layer of material 504*b* in a peeling direction 510. As such, in this example, the physical trigger is a separating of the layers of the material within the multi-layer probe 504.

Figure 5D:
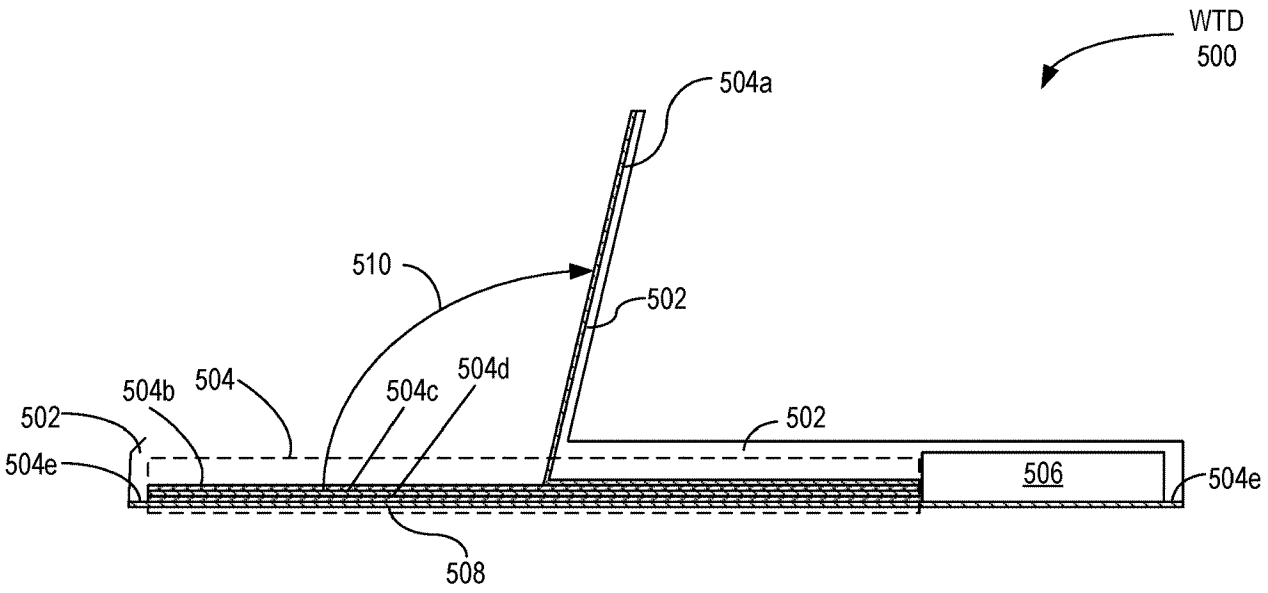
FIG. 5D is a side-view of the WTD, shown in FIG. 5C, where the trigger event has occurred in accordance with the present disclosure.

It is appreciated by those of ordinary skill in the art that any deformation or damage of the multi-layer probe 504 is also applicable in this example and large separation of the first layer of material 504*a* from the second layer of material 504*b* (as an example of break or extensive damage of the multi-layer probe 504) is shown for purposes of ease of illustration. Moreover, the separation, deformation, or damage may be between any of the layers of material 504*a*, 504*b*, 504*c*, 504*d*, or 504*e*. In FIG. 5D, a side-view is shown of the WTD 500 where the trigger event has occurred in accordance with the present disclosure.

Figure 6A:
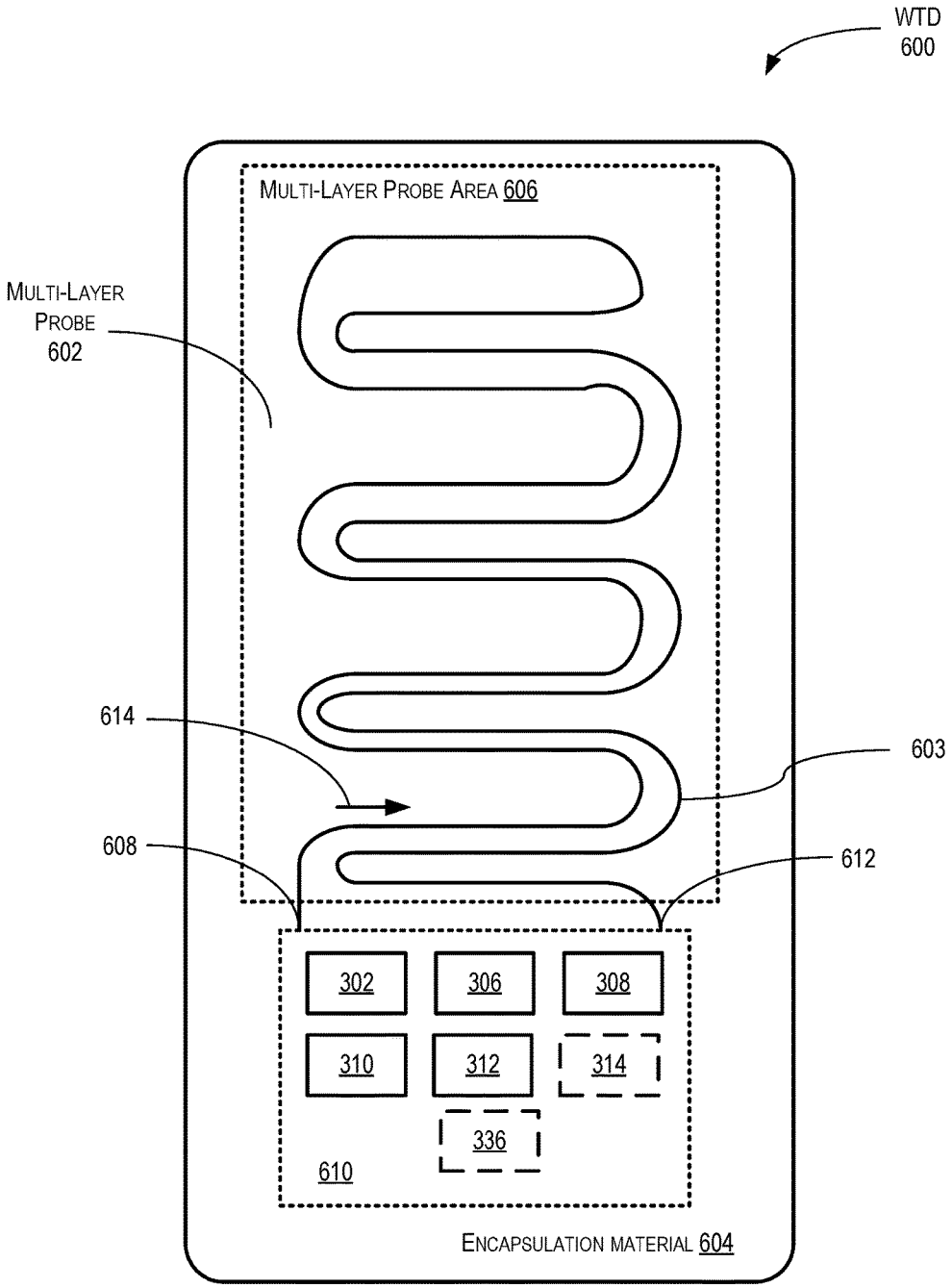
FIG. 6A is a block system diagram of an example of an implementation of the WTD, shown in FIG. 3, as a flat "Band-Aid" type of device in accordance with the present disclosure.

In FIG. 6A, a block system diagram is shown of an example of an implementation of the WTD 600 as a flat rectangular Band-Aid type of device (i.e., a security tape or security label type of device) in accordance with the present disclosure. This example is similar to the one described in FIGS. 5A through 5D, with the addition of having conductive wire or strip within the multi-layer probe 602 that may be part of any of the multiple layers of material 504*a*, 504*b*, 504*c*, 504*d*, or 504*e* shown in FIGS. 5A through 5D.

In this example, the encapsulation material 604 is in the shape of a large rectangular flat Band-Aid. The multi-layer probe 602 extends throughout the encapsulation material 604 in a turning fashion that fills a multi-layer probe area 606 along a first portion of the encapsulated material 604. As an example, the multi-layer probe 602 may (as discussed earlier) include multiple layers of material and an electrical wire or strip 603 (or other electrically conductive material with the proper performance properties of current, resistance, capacitance, voltage, etc.) that is of sufficient thickness to detect any tampering along the multi-layer probe area 606. In this example, the multi-layer probe 602 extends outward from a first end 608 of an electronic portion 610 to a second end 612 of the electronic portion 610 via the electrical wire or strip 603 or other conductive material layers within the multi-layer probe 602. In this example, the multi-layer probe 602 may include the continuous electrical wire or strip 603 that forms a closed circuit within the WTD 600 such that a current 614 flows from and to the electronic portion 610 when the multi-layer probe 602 is untampered. In this example, the electronic portion 610 is part of the encapsulation material 604 and includes the transmitter 302, receiver 312, antenna 310, processing device 306, power supply, and part, or all, of the multi-layer probe 602. The electronic portion 610 may also include the optional sensor 314 and optional trigger switch 336. In this example, the electronic portion 610 includes the power supply 308 and a SOC, ASIC, FPGA, or a substrate or PCB having the transmitter 302, receiver 312, antenna 310, and processing device 306. In this example, the WTD 600 detects tampering (i.e., a physical trigger) via a deformation, damage, or break in the multi-layer probe 602 along the multi-layer probe area 606 within the multi-layer probe 602. As an example, the deformation, damage, or break in the multi-layer probe 602 may include a break in the electrical wire or strip 603.

Prior to any tampering activity, the multi-layer probe 602 is continuous and undamaged. The WTD 600 is attached to a surface (or across multiple surfaces) and detects when there has been physical separation from the attaching surface or surfaces that causes deformation, damage, or a break of the multi-layer probe 602. In this example, the WTD 600 can attach to a flat surface (e.g., utilizing the attachment surface 508), it is appreciated that in this example the electronic portion 610 is at one end of the WTD 600 such that the WTD 600 can be utilized for a corner application.

Figure 6B:
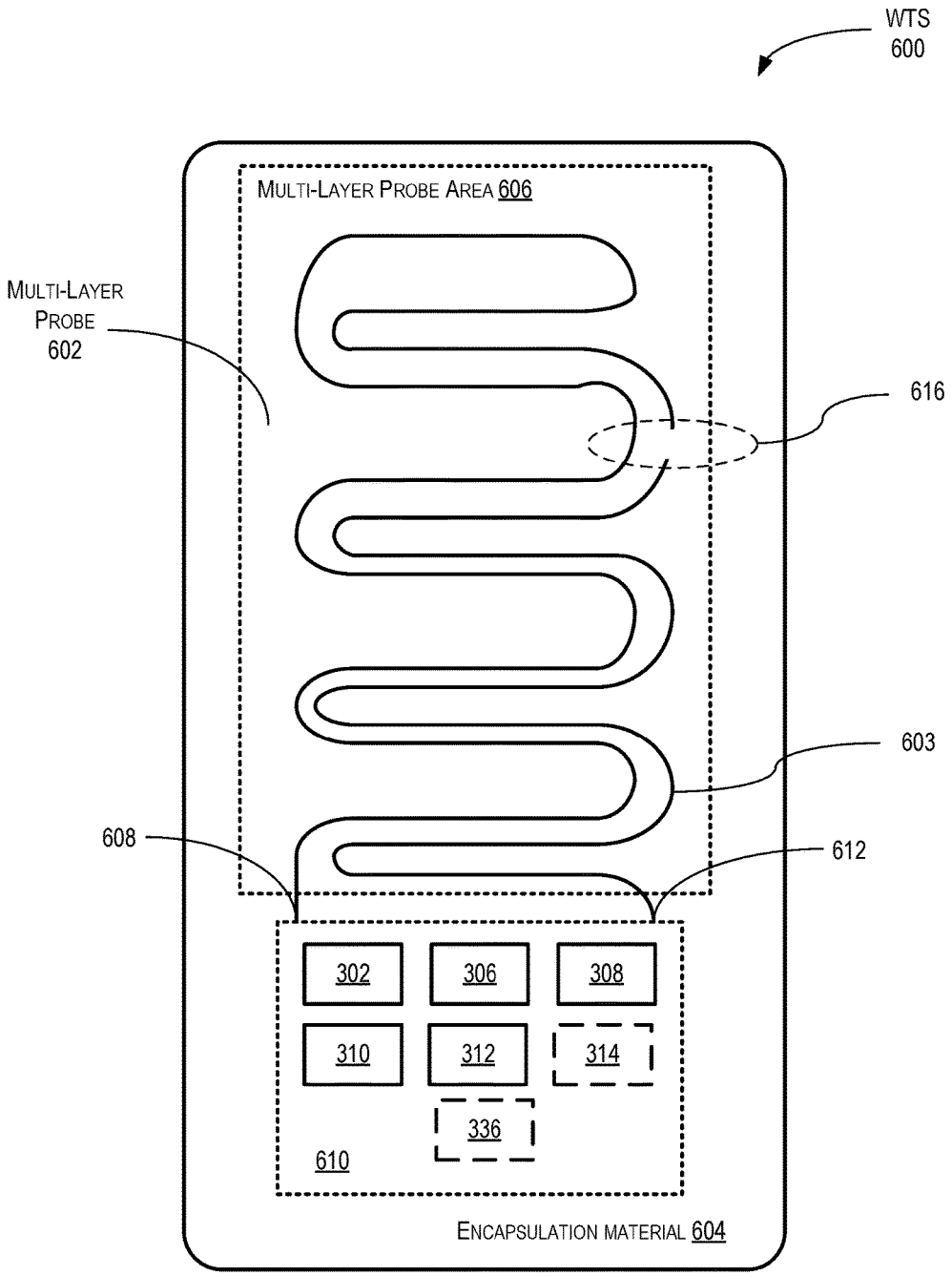
FIG. 6B is a block system diagram of the WTD, shown in FIG. 6A, after being tampered in accordance with the present disclosure.

Similar to the previous example, in an example of operation, the WTD 600 receives wake command from an external device that is authenticated as an authenticated interrogator by the WTD 600 performing a series of predetermined security protocols. As described earlier, in another example, the wake command may not cause the WTD 600 to set the tampered state to untampered. Once authenticated, the WTD 600 transmits a tamper state back to the interrogator (i.e., the external device). More specifically, the WTD 600 may first authenticate, then check the current state of the tamper, write and/or compile a report, and transmit the tamper state to the interrogator. As described earlier, if a tamper has occurred (i.e., the WTD 600 has experienced a physical trigger), the WTD 600 may either send back a tamper state signal indicating that the tamper state of the WTD 600 is "tampered," or the WTD 600 will not send back the tamper state signal at all. It is appreciated from the previous description that in this example, the multi-layer probe 602 and antenna 310 may be the same element and as such when the multi-layer probe 602 is broken the antenna 310 will be broken and have a shorted antenna length causing the WTD 600 to send back and altered (i.e., frequency shifted) tamper state signal. In the case of no tamper state signal being sent back, as described earlier, the damage to the multi-layer probe 602 may be such that the WTD 600 is incapable of transmitting the tamper state signal. For example, the multi-layer probe 602 and antenna 310 are the same an too damaged to transmit the tamper state signal or the multi-layer probe 602 is separate from the antenna 310 but once the multi-layer probe 602 is broken the current 614 flow within the WTD 600 is interrupted and the disables the operation of the WTD 600. As another example, the WTD 600 is simply designed to transmit the tamper state signal to the external device only when the WTD 600 is untampered but once tampered, the WTD 600 stops transmitting the tamper state signal. In all of these examples, the WTD 600 provides both a wireless and visual indication of tamper evidence. In FIG. 6B, a block system diagram is shown of the WTD 600 after being tampered in accordance with the present disclosure. The physical trigger 616 is shown as a fissure along the multi-layer probe 602 via the electrical wire or strip 603.

As discussed earlier, in this example the electrical wire or strip 603 is utilized to detect the tamper; however, alternatively the multi-layer probe 602 may not include an electrical wire or strip 603 an may utilize at least one conductive layer within the multi-layer probe 602 that conducts the current 614 along the at least one conductive layer from the first end 608 of an electronic portion 610 to the second end 612 of the electronic portion 610. As such, the physical trigger 616 may be a deformation, damage, or break (i.e., a fissure) along the multi-layer probe 602 that has multiple layers of material without the electrical wire or strip 603. As such, any tampering would result in the deformation, damaging, or breaking of the at least one conductive layer, the other non-conductive dielectric layers, or both that would change the electrical characteristics of the multi-layer probe 602 from the original predetermined electrical characteristics. This change in electrical characteristics may be detected by the electronic portion 610 of the WTD 600 and flagged as a tampering event indicative of the physical trigger 616. In this alternative example, the physical trigger 616 may be a peeled off type of damage similar to the one described with regards to FIGS. 5C and 5D.

Figure 7A:
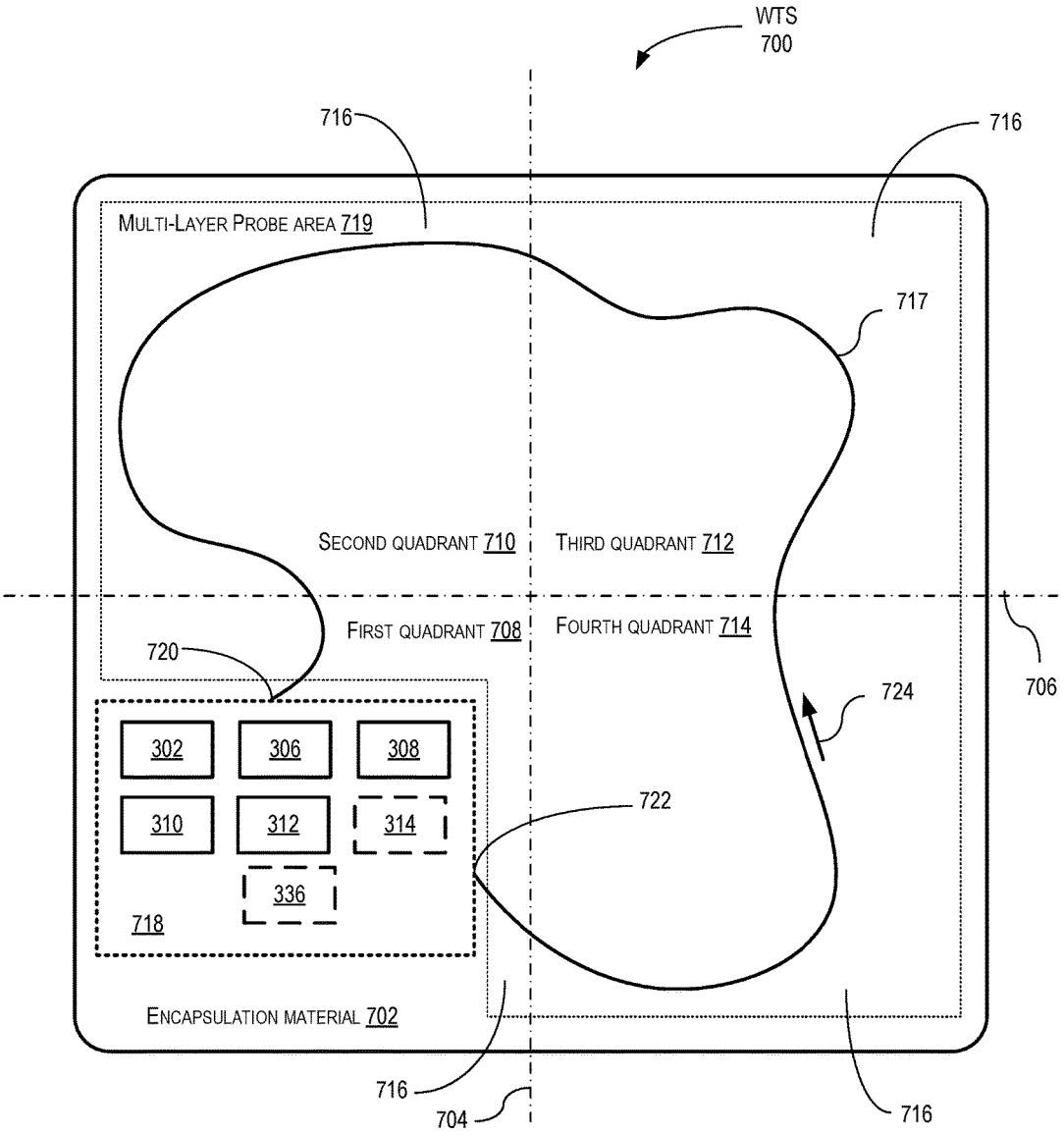
FIG. 7A is a block system diagram of an example of an implementation of the WTD, shown in FIG. 3, as a hybrid type of device in accordance with the present disclosure.

In FIG. 7A, a block system diagram is shown of an example of an implementation of the WTD 700 as a hybrid type of device in accordance with the present disclosure. In this example, the encapsulation material 702 may be in the shape of a flat sheet that has a first axis 704 and a second axis 706 that divide up the flat sheet into a first quadrant 708, second quadrant 710, third quadrant 712, and fourth quadrant 714. The power supply 308 and other electronics reside in one quadrant (i.e., the first quadrant 708) of the WTD 700 to provide corner or cross surface applications for the WTD 700. In this example, the encapsulation material 702 includes the multi-layer probe 716 that is in portions of all four quadrants 708, 710, 712, and 714 and an electronics portion 718 of the WTD 700 that includes the transmitter 302, receiver 312, antenna 310, processing device 306, power supply 308, and part of the multi-layer probe 716. The portions of all four quadrants 708, 710, 712, and 714 that include the multi-layer probe 716 are shown as a multi-layer probe area 719 that extends out of the electronics portion 718. The electronics portion 718 may also include the optional sensor 314 and optional trigger switch 336. In this example, the electronics portion 718 includes the power supply 308 and a SOC, ASIC, FPGA, or a substrate or PCB having the transmitter 302, receiver 312, antenna 310, and processing device 306. As described earlier, as an example, the multi-layer probe 716 may include an electrical wire or strip 717 (or other electrically conductive material with the proper performance properties of current, resistance, capacitance, voltage, etc.) that is of sufficient thickness to detect any tampering along a multi-layer probe area 719 and is part of all four quadrants 708, 710, 712, and 714. As before, in this example, the multi-layer probe 716 is shown to extend outward from a first end 720 of the electronics portion 718 to a second end 722 of the electronics portion 718. In this example, the multi-layer probe 716 may include the continuous electrical wire or strip 717 that forms a closed circuit within the WTD 700 such that a current 724 flows from and to the WTD 700 when the multi-layer probe 716 is untampered. As described earlier, in one example, the multi-layer probe 716 and antenna 310 may be the same element.

Figure 7B:
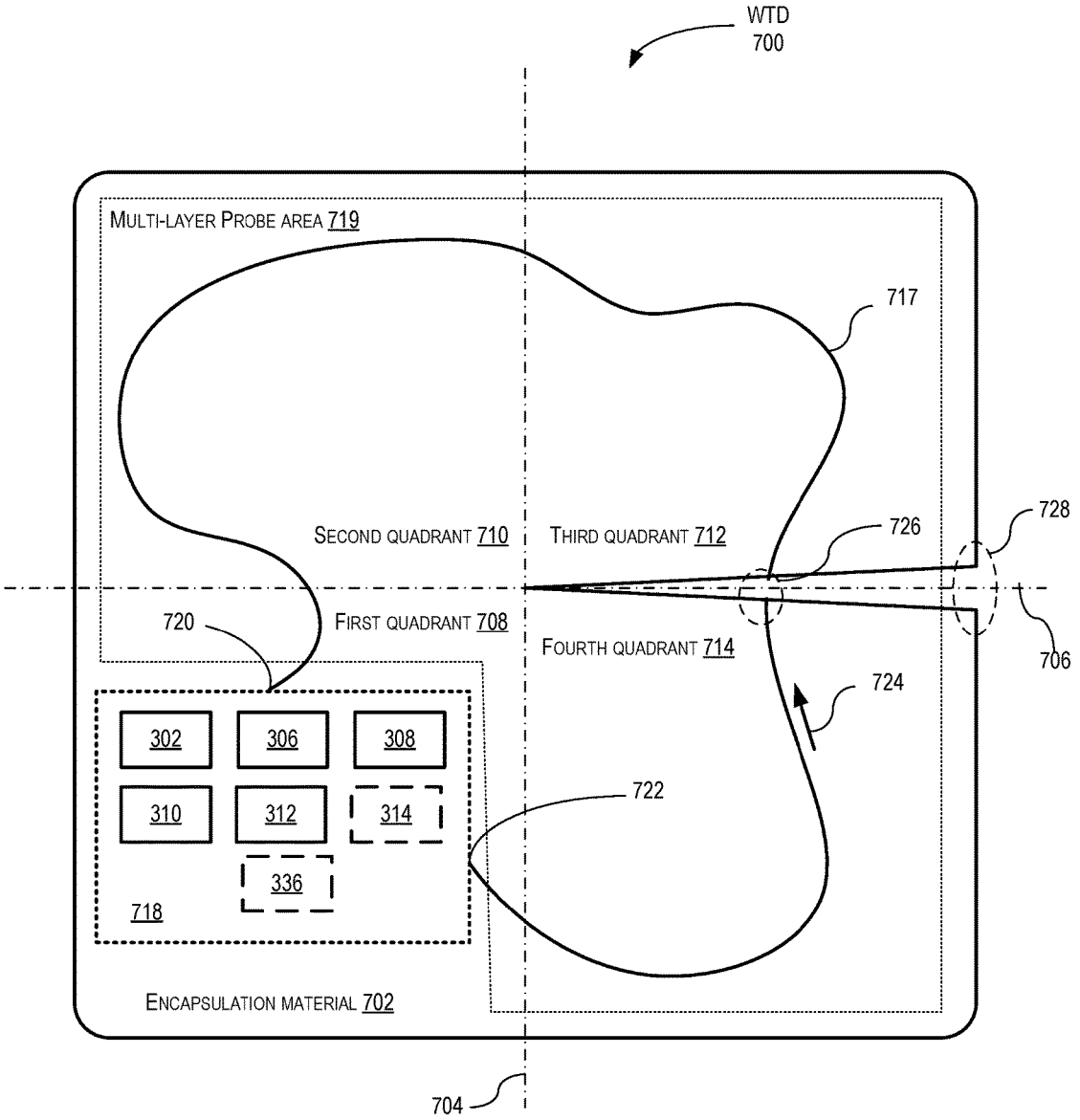
FIG. 7B is a block system diagram of the WTD, shown in FIG. 7A, after being tampered in accordance with the present disclosure.

Moreover, in this example, in FIG. 7B, the WTD 700 detects tampering (i.e., a physical trigger) via deformation, damage, or a break 726 (i.e., a fissure) in the multi-layer probe 716 along the multi-layer probe area 719, which is a break or rip 728 in the encapsulation material 702 and a break 726 in the multi-layer probe 716 (that may include a break in the electrical wire or strip 717) along one of the axis 704 and 706. Alternatively, the break 726 may be a peeled off type of damage similar to the one described with regards to FIGS. 5C and 5D. In all of these example, the WTD 700 may or may not include the electrical wire or strip 717 shown. As before, if no electrical wire or strip 717 is present, the multi-layer probe 716 may include multiple layers of material that include at least one conductive layer that is in contact with the first end 720 of the electronics portion 718 to a second end 722 of the electronics portion 718 and electronics portion 718 is configured to detect a tampering event along the multi-layer probe 716.

Similar to the previous examples, in an example of operation, the WTD 700 receives wake command from an external device that is authenticated as an authenticated interrogator by the WTD 700 performing a series of predetermined security protocols. As described earlier, in another example, the wake command may not cause the WTD 700 to set the tampered state to untampered. Once authenticated, the WTD 700 transmits a tamper state back to the interrogator (i.e., the external device). More specifically, the WTD 700 may first authenticate, then check the current state of the tamper, write and/or compile a report, and transmit the tamper state to the interrogator. As described earlier, if a tamper has occurred (i.e., the WTD 700 has experienced a physical trigger), the WTD 700 may either send back a tamper state signal indicating that the tamper state of the WTD 700 is "tampered," or the WTD 700 will not send back the tamper state signal at all. It is appreciated from the previous description that in this example, the multi-layer probe 716 and antenna 310 may be the same element and as such when the multi-layer probe 716 is broken the antenna 310 will be broken and have a shorted antenna length causing the WTD 700 to send back an altered (i.e., frequency shifted) tamper state signal. In the case of no tamper state signal being sent back, as described earlier, the damage to the multi-layer probe 716 may be such that the WTD 700 is incapable of transmitting the tamper state signal. For example, the multi-layer probe 716 and antenna 310 are the same an too damaged to transmit the tamper state signal or the multi-layer probe 716 is separate from the antenna 310 but once the multi-layer probe 716 is broken the current 724 flow within the WTD 700 is interrupted and the disables the operation of the WTD 700. As another example, the WTD 700 is simply designed to transmit the tamper state signal to the external device only when the WTD 700 is untampered but once tampered, the WTD 700 stops transmitting the tamper state signal. In all of these examples, the WTD 700 provides both a wireless and visual indication of tamper evidence. In FIG. 7B, a block system diagram is shown of the WTD 700 after being tampered in accordance with the present disclosure. The physical trigger 726 is shown as a fissure along the multi-layer probe 716 along a rip 728 in the encapsulation material 702.

Figure 8:
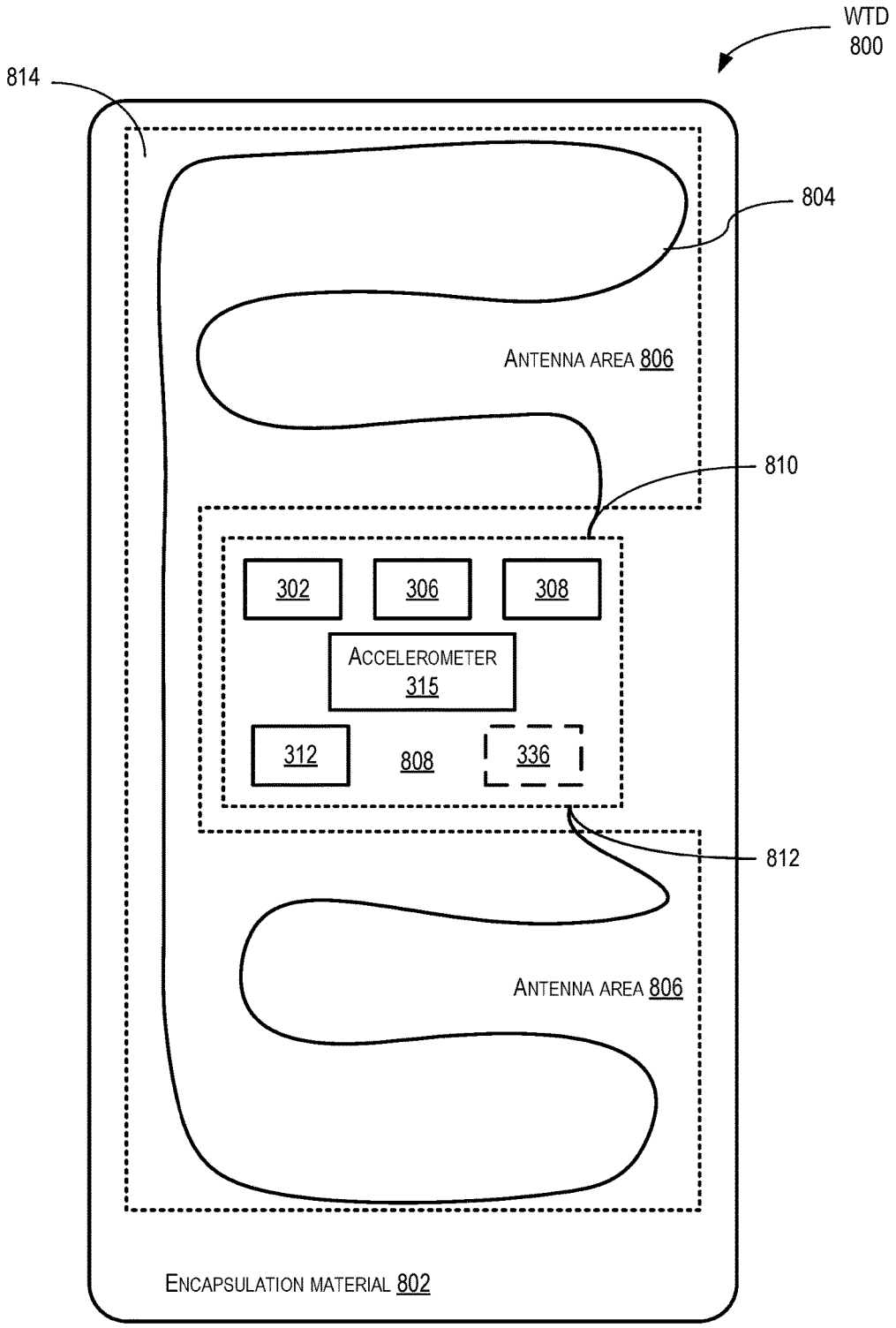
FIG. 8 is a block system diagram of an example of an implementation of the WTD, shown in FIG. 3, which is resettable in accordance with the present disclosure.

In FIG. 8, a block system diagram is shown of an example of an implementation of the WTD 800 that is resettable in accordance with the present disclosure. In this example, the encapsulation material 802 may be in the shape of a flat rectangular sheet that includes part of the antenna 804 within an antenna area 806 of the encapsulation material 802. The antenna 804 extends through the antenna area 806 in a manner that fills the antenna area 806. Within the encapsulation material 802 is also an electronics portion 808 that includes the power supply 308 and a SOC, ASIC, FPGA, or a substrate or PCB having the transmitter 302, receiver 312, accelerometer 315, and the processing device 306. The electronics portion 808 may also include the optional trigger switch 336. In this example, the antenna 804 is shown extending outward from a first end 810 of the electronics portion 808 to an optional second end 812 of the electronics portion 808. As an example, the antenna 804 may be a wire, foil, or electro-deposited metal. In this example, the antenna 804 may be an electrical wire, strip, or a conductive layer of material within a multi-layer probe 814.

In this example, the WTD 800 detects tampering (i.e., a physical trigger) via the accelerometer 315. Specifically, the accelerometer 315 is designed to detect a physical trigger based on movements or vibrations on the WTD 800. Because the internal and external components of the WTD 800 are not altered after a physical trigger (i.e., the WTD 800 is not broken or damaged), the WTD 800 is resettable and can detect multiple physical triggers (i.e., tamper events) throughout its design life.

Similar to the previous examples, in an example of operation, the WTD 800 receives wake command from an external device that is authenticated as an authenticated interrogator by the WTD 800 performing a series of predetermined security protocols. As described earlier, in another example, the wake command may not cause the WTD 800 to set the tampered state to untampered. Once authenticated, the WTD 800 transmits a tamper state back to the interrogator (i.e., the external device). More specifically, the WTD 800 may first authenticate, then check the current state of the tamper, write and/or compile a report, and transmit the tamper state to the interrogator. As described earlier, if a tamper has occurred (i.e., the WTD 800 has experienced a physical trigger), the WTD 800 may either send back a tamper state signal indicating that the tamper state of the WTD 800 is "tampered," or the WTD 800 will not send back the tamper state signal at all. In the case of not sending back the tamper state signal, the WTD 800 may simply be designed to transmit the tamper state signal to the external device only when the WTD 800 is untampered but once tampered, the WTD 800 stops transmitting the tamper state signal. Since the WTD 800 is not damaged by detecting the physical trigger, after the physical trigger has been detected, the WTD 800 may be reset to an untampered state for reuse in detecting another physical trigger. The WTD 800 may be reset by receiving a reset signal from the external device after the WTD 800 was placed in a tampered state; the WTD 800 may then be reutilized. Alternatively, the WTD 800 may also be reset by a user again activating the optional trigger switch 336.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

The flowchart and block diagrams in the different depicted example of implementations illustrate the architecture, functionality, and operation of some possible implementations of apparatuses and methods in an illustrative example. In this regard, each block in the flowchart or block diagrams may represent a module, a segment, a function, a portion of an operation or step, some combination thereof.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A wireless tamper sensor comprising:

a transmitter;

a receiver;

a multi-layer probe having predetermined electrical characteristics;

a processing device in signal communication with the multi-layer probe; and a power supply in signal communication with the transmitter and the processing device, wherein the processing device includes:

a processor; and a computer-readable medium accessible to the processor, the computer-readable medium storing instructions that are executable by the processor to:

initiate a tamper state of the wireless tamper sensor to untampered responsive to the wireless tamper sensor being armed by a user;

detect a physical trigger on the multi-layer probe;

set the tamper state to tampered in response to detecting the physical trigger;

receive a wake command from an external device, wherein the user utilizes the external device to arm the wireless tamper sensor with the wake command;

authenticate the wake command; and setting the tamper state to untampered responsive to the wake command being authenticated.

2. The wireless tamper sensor of claim 1, further comprising an encapsulating material that encloses at least a portion of the wireless tamper sensor.

3. The wireless tamper sensor of claim 1, further comprising a trigger switch, wherein the trigger switch is configured to be armed by the user, and wherein the instructions are further executable by the processor to set the tamper state to untampered responsive to the trigger switch being activated.

4. The wireless tamper sensor of claim 1, wherein the multi-layer probe is an antenna having an antenna length, and wherein the physical trigger is a reduction of the antenna length.

5. The wireless tamper sensor of claim 1, wherein detecting the physical trigger on the multi-layer probe includes determining that the multi-layer probe has new electrical characteristics as a result of the physical trigger.

6. The wireless tamper sensor of claim 5, wherein the physical trigger is a separating of a layer of material within the multi-layer probe.

7. The wireless tamper sensor of claim 1, further comprising a sensor in signal communication with the processing device, wherein the sensor senses the physical trigger on the multi-layer probe.

8. The wireless tamper sensor of claim 1, wherein the instructions are further executable by the processor to transmit a tamper state signal in response to detecting the physical trigger, wherein the tamper state signal indicates that the tamper state is either tampered or untampered.

9. The wireless tamper sensor of claim 8, wherein the instructions are further executable by the processor to:

receive a status command from the external device;

authenticate the status command; and transmit the tamper state signal in response to receiving the status command, wherein the tamper state signal indicates that the tamper state is either tampered or untampered.

10. The wireless tamper sensor of claim 1, further comprising an accelerometer, wherein detecting the physical trigger includes detecting a movement or vibration with the accelerometer.

11. The wireless tamper sensor of claim 10, wherein the instructions are further executable by the processor to:

receive a reset signal from the external device; and reset the tamper state to untampered in response to receiving the reset signal.

12. The wireless tamper sensor of claim 1, wherein the processing device includes a field programmable-gate array.

13. A method for detecting tampering on a wireless tamper device, the method comprising:

arming the wireless tamper device by a user, wherein arming includes initiating a tamper state of the wireless tamper device to untampered;

detecting a physical trigger on a multi-layer probe;

setting the tamper state to tampered in response to detecting the physical trigger;

receiving a wake command from an external device, wherein the user utilizes the external device to arm the wireless tamper device with the wake command;

authenticating the wake command; and setting the tamper state to untampered responsive to the wake command being authenticated.

14. The method of claim 13, further comprising transmitting a tamper state signal in response to detecting the physical trigger, wherein the tamper state signal indicates that the tamper state is tampered.

15. The method of claim 13, further comprising:

receiving a status command from the external device;

authenticate the status command; and transmitting a tamper state signal in response to receiving the status command.

16. The method of claim 15, wherein detecting the physical trigger includes determining that the multi-layer probe has been broken or substantially altered.

17. The method of claim 16, wherein the multi-layer probe is an antenna.

18. The method of claim 14, wherein detecting the physical trigger includes detecting a movement or vibration with an accelerometer.

19. The method of claim 18, further comprising:

receiving a reset signal from the external device; and resetting the tamper state to untampered.

* * * * *